United States Patent [19]

Fratangelo

[11] Patent Number: 4,751,547

[45] Date of Patent: Jun. 14, 1988

[54] SHEET GUIDE

[75] Inventor: Louis D. Fratangelo, Fairport, N.Y.

[73] Assignee: Xerox Corporation, Stamford, Conn.

[21] Appl. No.: 85,579

[22] Filed: Aug. 14, 1987

[51] Int. Cl.[4] ..... G03G 15/00

[52] U.S. Cl. ..... 355/3 SH; 355/3 TR; 271/306

[58] Field of Search ..... 355/3 TR, 3 SH, 14 SH, 355/14 TR; 271/306, 312, 313

[56] References Cited

U.S. PATENT DOCUMENTS

| | | | |
|---|---|---|---|
| 4,101,212 | 7/1978 | Sumiyoshi et al. | 355/3 TR |
| 4,183,653 | 1/1980 | Satomi et al. | 355/3 SH |
| 4,417,800 | 11/1983 | Hirose et al. | 271/312 X |
| 4,491,407 | 1/1985 | Mitsuyama et al. | 355/3 TR |
| 4,525,057 | 6/1985 | Kaufmann et al. | 355/3 TR |
| 4,561,756 | 12/1985 | Lang | 355/3 TR |
| 4,579,441 | 4/1986 | Hart et al. | 355/3 TR |
| 4,579,447 | 4/1986 | Kato | 355/3 TR |

*Primary Examiner*—R. L. Moses

*Attorney, Agent, or Firm*—H. Fleischer; J. E. Beck; R. Zibelli

[57] ABSTRACT

An apparatus in which a range of differing weight copy sheets are advanced from a processing station of an electrophotographic printing machine. At the processing station, developed images are transferred from a moving image bearing member to copy sheets. The copy sheets are separated from the image bearing member with a light weight copy sheet being separated from the image bearing member at a first position. Heavier weight copy sheets are separated from the image bearing member at other positions. The first position is after the other positions in the direction of movement of the image bearing member. A guide is provided for guiding the heavier weight copy sheets onto the sheet transport with the light weight copy sheet being received on the sheet transport without contacting the guide.

10 Claims, 2 Drawing Sheets

SHEET GUIDE

This invention relates generally to an electrophotographic printing machine, and more specifically concerns an apparatus for advancing a range of differing weight copy sheets from a processing station in the printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material is made from toner particles adhering triboelectrically to carrier granules. The toner particles are attracted from the carrier granules to the latent image forming a toner powder image on the photoconductive member. The toner powder image is then transferred from the photoconductive member to a copy sheet. Heat is applied to the toner particles to permanently affix the powder image to the copy sheet.

High speed commercial printing machines of the foregoing type handle a wide range of differing weight copy sheets. The beam strength of the copy sheet is a function of the weight of the sheet. Heavier weight copy sheets have greater beam strength than lighter weight copy sheets. At the processing station where the developed image is transferred to the copy sheet, the copy sheet adheres to the photoconductive member. As the photoconductive member moves with the copy sheet, the beam strength of the copy sheet aids in the separation of the copy sheet from the photoconductive member after transfer of the developed image thereto. Thus, heavier weight copy sheets separate earlier from the photoconductive member than lighter weight copy sheets. Typically, a conveyor is employed to advance the copy sheets from the transfer station to the fusing station. As the copy sheet leaves the transfer station, it is acquired by the conveyor. Inasmuch as lighter weight copy sheets separate later than heavier weight sheets, the conveyor is normally positioned to receive the lighter weight sheet. However, under these circumtances it has been found that the heavier weight sheets stub against the conveyor and are not reliably acquired by the conveyor. Alternatively, if the conveyor is positioned to prevent the heavier weight copy sheets from stubbing against the conveyor, the lighter weight copy sheets are not reliably acquired by the conveyor. The inability to acquire the copy sheet in a reliable manner causes sheet jams which result in the printing machine being inoperable until the jam is cleared. Thus, it is desirable to be able to minimize, in an inexpensive manner, sheet jams caused by using differing weight copy sheets.

Various approaches have been devised for solving this problem. For example, other commercial products overcome this problem by employing a vacuum plenum to acquire the sheet. However, this approach is costly. The following disclosure appears to be relevant:

U.S. Pat. No. 4,183,6563, Patentee: Satomi et al. Issued: Jan. 15, 1980.

The relevant portions of the foregoing patent may be summarized as follows:

Satomi et al., in FIGS. 1 and 6, shows a guide, adjacent a corona discharge unit, interposed between the corona discharge unit and a conveyor. The conveyor has a vacuum plenum associated therewith. This patent, in column 4, lines 53 through 55, inclusive, states that "The leading edge portion of the copy sheet 18 thus separated from the drum 12 is guided over a guide 47 onto the conveyor belt 23."

In accordance with one aspect of the present invention, there is provided an apparatus for advancing a range of differing weight copy sheets from a processing station adapted to transfer a developed image from a moving image bearing member to the copy sheets. The apparatus includes means for separating the copy sheets from the image bearing member with a light weight copy sheet being separated from the image bearing member at a first position and heavier weight copy sheets separated from the image bearing member at other positions. The first position is after the other positions in the direction of movement of the image bearing member. Means, positioned to receive the leading edge of the light weight copy sheet separated from the image bearing member at the first position, transport the copy sheets away from the transfer station. Means, interposed between the separating means and the transporting means, are provided for guiding the heavier weight copy sheets separated from the image bearing member at the other positions onto the transporting means. The transporting means is positioned to receive the light weight copy sheet separated from the image bearing member at the first position without the leading edge of the light weight copy sheet contacting the guiding means.

Pursuant to another aspect of the features of the present invention, there is provided an electrophotographic printing machine of the type in which differing weight copy sheets are advanced from a transfer station, where a developed image is transferred from a moving photoconductive member to the copy sheets, to a fusing station, where the developed image is affixed to the copy sheets. The printing machine includes means for separating the copy sheets from the photoconductive member with a light weight copy sheet being separated from the photoconductive member at a first position and heavier weight copy sheets separated from the photoconductive member at other positions. The first position is after the other positions in the direction of movement of the photoconductive member. Means, positioned to receive the leading edge of the light weight copy sheet separated from the photoconductive member at the first position, transport the copy sheets away from the transfer station. Means, interposed between the separating means and the transporting means, are provided for guiding the heavier weight copy sheets separated from the photoconductive member at the other positions onto the transporting means. The transporting means is positioned to receive the light weight copy sheet separated from the photoconductive member at the first position without the leading edge of the light weight copy sheet contacting the guiding means.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
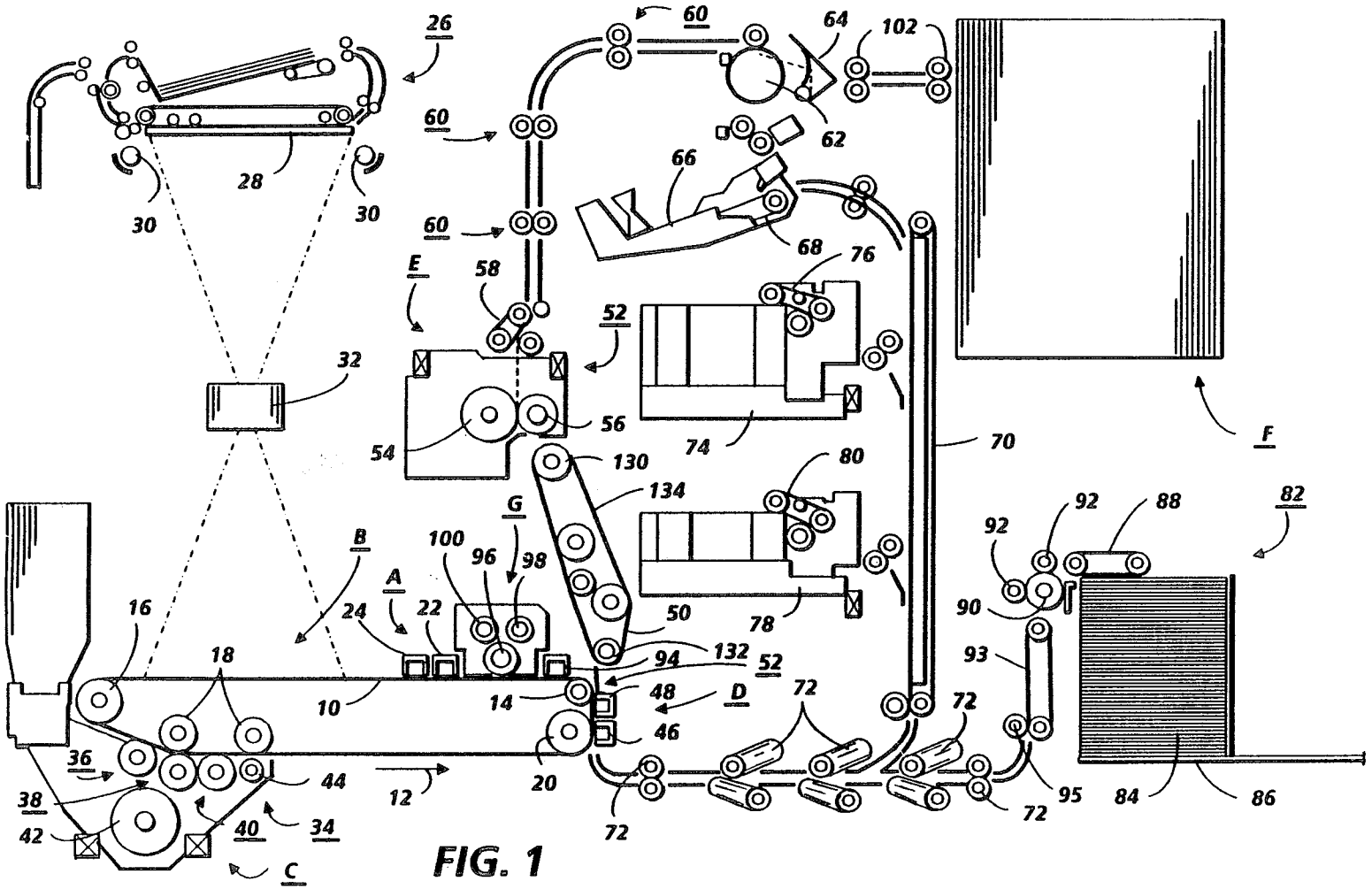
FIG. 1 is a schematic elevational view depicting an illustrative electrophotographic printing machine incorporating the apparatus of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the apparatus of the present invention may be employed in a wide variety of devices and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on an anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, rollers 18, and drive roller 20. Stripping roller 14 and rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of photoconductive belt 10 passes through charging station A. At charging station A, two corona generating devices, indicated generally by the reference numerals 22 and 24 charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of photoconductive belt 10 is advanced through imaging station B. At imaging station B, a document handling unit, indicated generally by the reference numeral 26, is positioned over platen 28 of the printing machine. Document handling unit 26 sequentially feeds documents from a stack of documents placed by the operator in the document stacking and holding tray. The original documents to be copied are loaded face up into the document tray on top of the document handling unit. A document feeder located below the tray forwards the bottom document in the stack to rollers. The rollers advance the document onto platen 28. When the original document is properly positioned on platen 28, a belt transport is lowered onto the platen with the original document being interposed between the platen and the belt transport. After imaging, the original document is returned to the document tray from platen 28 by either of two paths. If a simplex copy is being made or if this is the first pass of a duplex copy, the original document is returned to the document tray via the simplex path. If this is the inversion pass of a duplex copy, then the original document is returned to the document tray through the duplex path. Imaging of a document is achieved by two Xenon flash lamps 30 mounted in the optics cavity which illuminate the document on platen 28. Light rays reflected from the document are transmitted through lens 32. Lens 32 focuses the light image of the original document onto the charged portion of the photoconductive surface of belt 10 to selectively dissipate the charge thereon. This records an electrostatic latent image on photoconductive belt 10 which corresponds to the informational areas contained within the original document. Thereafter, photoconductive belt 10 advances the electrostatic latent image recorded thereon to development station C.

At development station C, a magnetic brush developer unit, indicated generally by the reference numeral 34, has three developer rolls, indicated generally by the reference numerals 36, 38 and 40. A paddle wheel 42 picks up developer material and delivers it to the developer rolls. When developer material reaches rolls 36 and 38, it is magnetically split between the rolls with half of the developer material being delivered to each roll. Photoconductive belt 10 is partially wrapped about rolls 36 and 38 to form extended development zones. Developer roll 40 is a cleanup roll. Magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detack the copy sheet from belt 10. As belt 10 continues to move in the direction of arrow 12, the beam strength of the copy sheet causes the copy sheet to separate from belt 10. Heavier weight copy sheets have greater beam strength than lighter weight copy sheets. Thus, the lighter weight copy sheets separate from belt 10 at a first position while the heavier weight copy sheets separate from the belt at other positions. The first separation position is after the other separation positions in the direction of movement of belt 10, as indicated by arrow 12. Conveyor 50, which advances the copy sheets to fusing station E, is positioned so that the leading edge of the lightest weight copy sheet used in the printing machine is acquired thereon upon separation of the leading edge of the copy sheet from belt 10. The leading edge of other, heavier weight copy sheets, will be spaced from the conveyor upon separation from belt 10. The leading edge of these heavier weight copy sheets will contact a sheet guide, indicated generally by the reference numeral 51, which will guide the sheet leading edge onto conveyor 50. Preferably, conveyor 50 has at least a pair of spaced rollers 130 and 132 having a belt 134 entrained thereabout. Further details of the apparatus will be discussed hereinafter with reference to FIGS. 2 and 3.

With continued reference to FIG. 1, conveyor 50 advances the differing weight copy sheets to Fusing station E. Fusing station E includes a fuser assembly, indicated generally by the reference numeral 52 which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent is transferred to a donor roll and then to the fuser roll.

After fusing, the copy sheets are fed through a decurler 58. Decurler 58 bends the copy sheet in one direction to put a known curl in the copy sheet and then bends it in the opposite direction to remove that curl.

Forwarding roller pairs 60 then advance the sheet to duplex turn roll 62. Duplex solenoid gate 64 guides the sheet to the finishing station F or to duplex tray 66. In the finishing station, the copy sheets are collected in sets with the copy sheets of each set being stapled or glued together. Alternatively, duplex solenoid gate 64 diverts the sheet into duplex tray 66. The duplex tray 66 provides an intermediate or buffer storage for those sheets that have been printed on one side and on which an image will be subsequently printed on the second, opposed side thereof, i.e. the sheets being duplexed. The sheets are stacked in duplex tray 66 face down on top of one another in the order in which they are copied.

In order to complete duplex copying, the simplex sheets in tray 66 are fed, in seriatim, by bottom feeder 68 from tray 66 back to transfer station D via conveyor 70 and rollers 72 for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 74. Secondary tray 74 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from the auxiliary tray 78. The auxiliary tray 78 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and then to transfer station D.

Secondary tray 74 and auxiliary tray 78 are secondary sources of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet to transfer station station D.

Invariably, after the copy sheet is separated from photoconductive belt 10, some residual particles remain adhering thereto. After transfer, photoconductive belt 10 passes beneath corona generating device 94 which charges the residual toner particles to the proper polarity. Thereafter, the precharge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 96 and two de-toning rolls 98 and 100, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
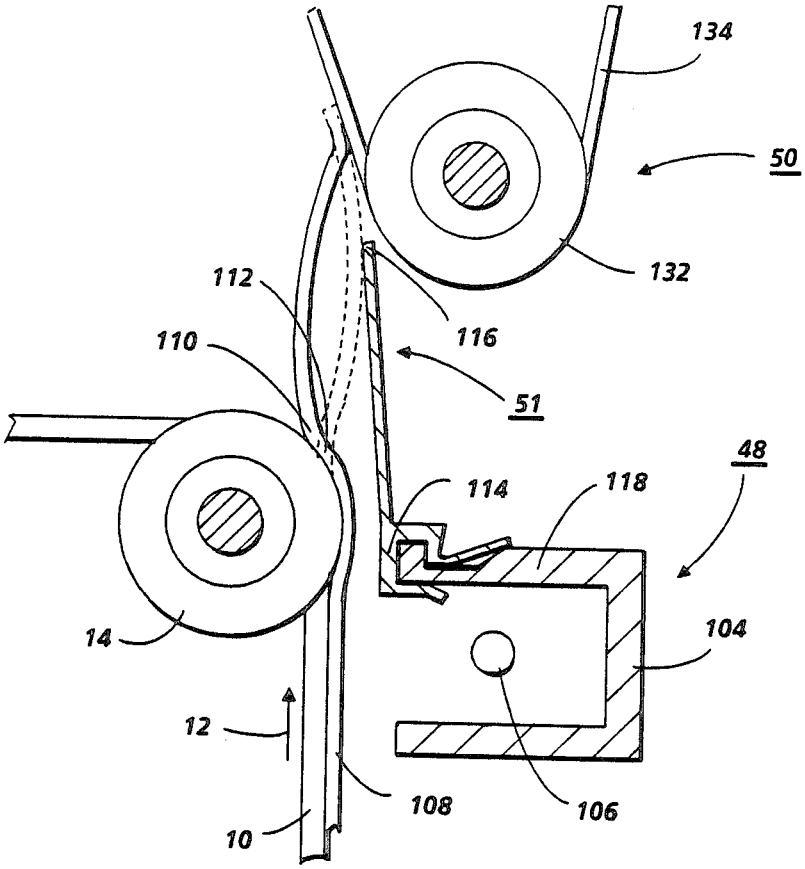
FIG. 2 is an elevational view showing the sheet guiding apparatus used in the FIG. 1 printing machine.

Referring now to FIG. 2, there is shown a fragmentary, elevational view illustrating the features of the present invention. As shown thereat, corona generating device 48 includes a U-shaped shield 104 and an elongated electrode wire 106. Corona generating device 48 is energized to neutralize the charge on copy sheet 108 causing it to adhere to belt 10. In this way, as belt 10 continues to move in the direction of arrow 12, copy sheet 108 separates therefrom as it bends around stripping roller 14. The lightest weight copy sheet employed in the printing machine, i.e. 13 pound paper, remains adhering to belt 10 for the longest period of time. The heaviest weight copy sheet employed in the printing machine, i.e. 110 pound paper, remains adhering to the belt for the shortest period of time. Thus, the lightest weight copy sheet, indicated by the solid lines, will separate from belt 10 at position 110. The heaviest weight copy sheet, indicated by dashed lines, will separate from belt 10 at position 112. Other weight copy sheets will separate from belt 10 at positions intermediate position 110 and position 112. Conveyor 50 is positioned to acquire the leading edge of the lightest weight copy sheet without the leading edge contacting sheet guide 51. The leading edges of other heavier weight copy sheets contact sheet guide 51 and are guided onto conveyor 50. Sheet guide 51 is mounted removably on shield 104 of corona generating device 48. One end 114 of guide 51 is snapped onto shield 104. The other, free end 116 of guide 51 is positioned closely adjacent to conveyor 50. More specifically, the free end 116 is positioned adjacent roller 132 with belt 134 being interposed therebetween. In this way, sheet guide 51 shingles the copy sheets that would normally stub on conveyor 50 permitting them to be smoothly acquired.

Figure 3:
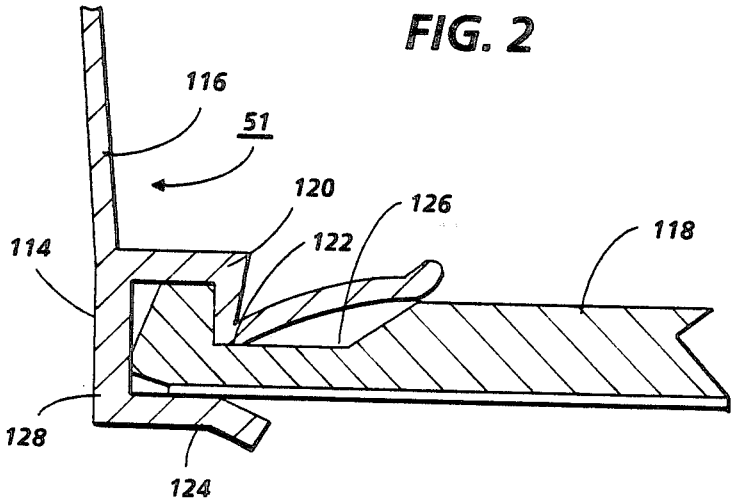
FIG. 3 is a fragmentary, elevational view illustrating the sheet guide used in the FIG. 2 apparatus.

Turning now to FIG. 3, there is shown a fragmentary, elevational view depicting the mounting of sheet guide 51 onto shield 104. Shield 104 of corona generating device 48 is U-shaped. Sheet guide 51 is mounted on leg 118 of shield 104. End 114 of sheet guide 51 is generally U-shaped with leg 120 having an inwardly directed generally V-shaped member 122 which reduces the cross-section of the U-shape of end 114. Leg 124 is generally planar. Sheet guide 51 is mounted on the free end of leg 118. End 114 is positioned so that cross member 128 abuts against the end of leg 118. This positions V-shaped member 122 in groove 126 of leg 118. In this manner, sheet guide 51 is snapped onto leg 118 of shield 104. This releasably secures sheet guide 51 to leg 118. Other than end 114, sheet guide 51 is a generally planar member. Preferably, sheet guide 51 is made from sheet metal and extends across the entire sheet path.

In recapitulation, the sheet advancing apparatus of the present invention advances differing weight copy sheets from the transfer station to the fusing station. The conveyor of the apparatus is positioned to acquire the lightest weight copy sheet with heavier weight copy sheets being guided thereto by a sheet guide. The sheet guide is interposed between the transfer station and the conveyor.

It is, therefore, evident that there has been provided, in accordance with the present invention, an apparatus that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An apparatus for advancing a range of differing weight copy sheets from a processing station adapted to transfer a developed image from a moving image bearing member to the copy sheets including:

means for separating the copy sheets from the image bearing member with a light weight copy sheet being separated from the image bearing member at a first position and heavier weight copy sheets being separated from the image bearing member at other positions with the first position being after the other positions in the direction of movement of the image bearing member;

means, positioned to receive the leading edge of the light weight copy sheet separated from the image bearing member at the first position, for transporting the copy sheets away from the transfer station; and means, interposed between said separating means and said transporting means, for guiding the heavier weight copy sheets separated from the image bearing member at the other positions onto said transporting means, said transporting means being positioned to receive the light weight copy sheet separated from the image bearing member at the first position without the leading edge of the light weight copy sheet contacting said guiding means.

2. An apparatus according to claim 1, wherein a charge attracts the copy sheets to the image bearing member, said separating means including a corona generating device adapted to neutralize the charge attracting the copy sheets to the image bearing member.

3. An apparatus according to claim 2, wherein said guiding means is mounted removably on said corona generating device.

4. An apparatus according to claim 3, wherein said guiding means includes a substantially planar member adapted to be secured at one end thereof to said corona generating device with the free end thereof being positioned adjacent said transporting means.

5. An apparatus according to claim 4, wherein said transporting means includes:

a pair of rollers spaced from one another; and a belt entrained about said pair of spaced rollers with one of said pair of rollers being positioned adjacent the free end of said guiding means with said belt interposed therebetween.

6. An electrophotographic printing machine of the type in which differing weight copy sheets are advanced from a transfer station, where a developed image is transferred from a moving photoconductive member to the copy sheets, to a fusing station, where the developed image is affixed to the copy sheets, including:

means for separating the copy sheets from the photoconductive member with a light weight copy sheet being separated from the photoconductive member at a first position and heavier weight copy sheets being separated from the photoconductive member at other positions with the first position being after the other positions in the direction of movement of the photoconductive member;

means, positioned to receive the leading edge of the light weight copy sheet separated from the photoconductive member at the first position, for transporting the copy sheets away from the transfer station; and means, interposed between said separating means and said transporting means, for guiding the heavier weight copy sheets separated from the photoconductive member at the other positions onto said transporting means, said transporting means being positioned to receive the light weight copy sheet separated from the photoconductive member at the first position without the leading edge of the light weight copy sheet contacting said guiding means.

7. A printing machine according to claim 6, wherein a charge attracts the copy sheets to the photoconductive member, said separating means including a corona generating device adapted to neutralize the charge attracting the copy sheets to the photoconductive member.

8. A printing machine according to claim 7, wherein said guiding means is mounted removably on said corona generating device.

9. A printing machines according to claim 8, wherein said guiding means includes a substantially planar member adapted to be secured at one end thereof to said corona generating device with the free end thereof being positioned adjacent said transporting means.

10. A printing machine according to claim 9, wherein said transporting means includes:

a pair of rollers spaced from one another; and a belt entrained about said pair of spaced rollers with one of said pair of rollers being positioned adjacent the free end of said guiding means with said belt interposed therebetween.

* * * * *